United States Patent [19]

Sam

[11] Patent Number: 4,786,045

[45] Date of Patent: Nov. 22, 1988

[54] OFFSETTING AND REGISTRATION PAPER TRANSPORT

[75] Inventor: Ronald W. Sam, Oxnard, Calif.

[73] Assignee: Xerox Corporation, Stamford, Conn.

[21] Appl. No.: 45,961

[22] Filed: May 4, 1987

[51] Int. Cl.[4] ..... B65H 9/16

[52] U.S. Cl. ..... 271/251

[58] Field of Search ..... 271/250, 251, 236

[56] References Cited

U.S. PATENT DOCUMENTS

| | | | |
|---|---|---|---|
| 4,440,389 | 4/1984 | Ames | 271/251 |
| 4,482,147 | 11/1984 | Hibi | 271/251 X |
| 4,546,964 | 10/1985 | Linthout | 271/251 X |
| 4,669,719 | 6/1987 | Fratangelo | 271/251 |

FOREIGN PATENT DOCUMENTS

| | | | |
|---|---|---|---|
| 53346 | 3/1984 | Japan | 271/251 |

*Primary Examiner*—Richard A. Schacher

*Attorney, Agent, or Firm*—Robert E. Cunha

[57] ABSTRACT

A registration mechanism for offsetting paper sets against a registration edge which is alternately in an inboard and an outboard position. The paper sheet is urged against the registration edge by means of two rotating urathane paddle wheels positioned relatively closely to the registration edge, but the sheet is prevented from generating too much angular velocity by two restraining means in the form of TEFLON balls held in retainers which prevent the balls from moving laterally but allow the balls to move vertically and rotationally, these restraining means located relatively further away from the registration edge. Because the mechanism is operating in the absence of a sheet of paper most of the time, a freely spinning roller is provided in a space in the base plate under each wheel which normally is driven by the wheel in the absence of a sheet of paper at a speed sychronous to that of the wheel, thereby lessening the wear on the wheel.

7 Claims, 4 Drawing Sheets

OFFSETTING AND REGISTRATION PAPER TRANSPORT

Background Of The Invention

This is a mechanism for aligning the paper output from a xerographic laser printer against either of two positions of a registration edge so that each set of documents produced will be offset to allow the operator to separate the document sets more easily, and more specifically is a set of paddle wheels and stationary balls which are designed to urge the edge of each output sheet against the registration edge reliably, but without buckling or wrinkling the paper.

It is typical in printers, as well as copiers, for the output to be in the form of multiple sets. To keep each set separated, the registration assembly offsets the sets so that they will be stacked in the output tray offset from each other, alternately in an inboard and then in an outboard direction, the separation distance being great enough to allow the operator to separate the sets easily.

It has been usual in the copier technology for the output stacker to use a paddle wheel to urge the paper against the moveable registration edge. For each set, the edge is moved to a new position, thereby guaranteeing that each set of copies will be easily differentiated from the next for the benefit of the operator. One problem frequently encountered is that, as the paper enters the offsetting area, for some skew angles, speeds and registration positions, the paddle wheels do not exert the proper force on the sheets to guarantee registration. This results in a scattering of the sheets or in a percentage of the sheets still being angled after reaching the output tray, depending on the paper weight and type, resulting in poor offset definition for successive sets of copies. In other cases, the paddle wheels exert too much force on the sheets, so that some sheets will wrinkle, or buckle and fold over, at the corner where the sheet first comes in contact with the registration edge.

What is required is an offsetting mechanism that will reliably force each sheet against the registration edge, but also will do so in a way that allows the paper to approach the edge at a speed and angle that is not conducive to buckling the corner of the sheet.

Additionally, it is required that this registration be accomplished while the paper is in motion. Prior systems have been able to accomplish registration without corner damage, but only by bringing the paper to a stop before registration.

Summary of the Invention

This invention is a mechanical offset and registration transport mechanism that will offset and register the output sheet to an internal registration edge which will alternately be in either its inboard or outboard position. In the inboard position the paper travels almost straight through, but in the outboard position the paper must be diverted through an angle, and either repositioning must be accomplished without stopping the movement of the paper. That is, it will register the sheets against the edge "on-the-fly". In this embodiment the sheet velocity is about 23 inches (585 mm) per second entering the output tray area, and is accelerated to about 40 inches (1015 mm) per second as a result of being acted on by the paddle wheels.

Specifically, in this embodiment, the registration edge is approximately lined up with the bypass sidewall in the inboard position and is recessed about 10 to 12 mm in the outboard position. Also, the paper enters the area moving parallel to, and 3 to 5 mm from, the sidewall. In order that the paddle wheels drive the sheets across either distance to the registration edge, and still not damage the sheets upon contact with the registration edge, the angle that the paper takes with respect to the edge must be kept to a minimum. Two stationary TEFLON balls are used in this machine to counteract the skew. They are located in position to reduce the angle of the paper after being acted upon by the paddle wheels, and to reduce the paper velocity.

The mechanism also includes two rollers, one positioned directly below each paddle wheel. In the absence of a sheet of paper, the rollers and wheels contact each other, each wheel driving its associated roller up to the identical rotational speed so that, in the absence of a sheet of paper, there will be no frictional wear on the wheel, as there would have been if the area below the wheel were just a continuation of the metal base member on which the sheet is supported as it travels through the registration area.

The mechanism described herein works equally well with paper ranging from 60 to 200 GSM (grams per square meter) Index stock, and with 8½ (216 mm) by 11 (279 mm) or 14 (356 mm), or A size paper (210×297 mm).

DETAILED DESCRIPTION OF THE INVENTION

Figure 1A:
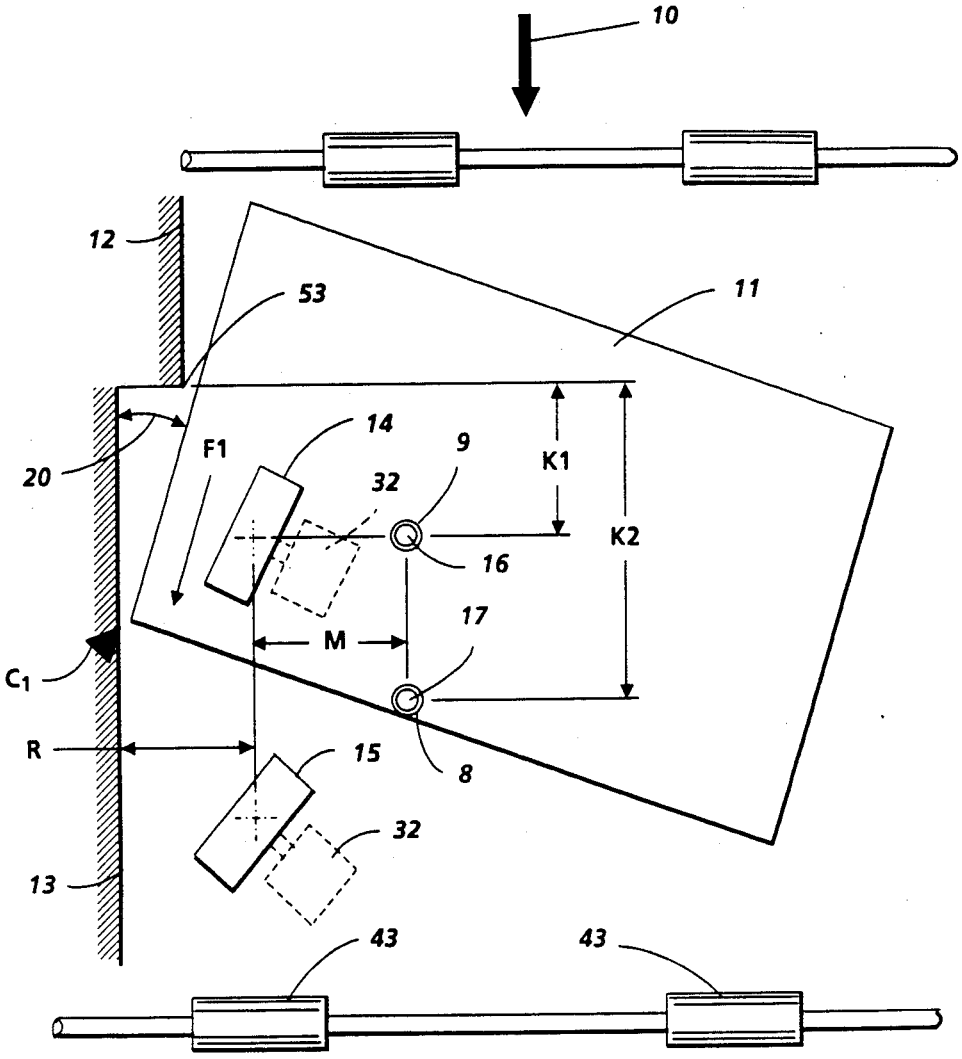
FIG. 1*a* is a top view of the mechanism.

FIG. 1*a* is an overview of the paper path and shows the major components of the system. The paper is traveling from top to bottom in this figure, as shown by arrow 10. Also, the long edge, 11 or 14 inches, is leading as shown by sheet 11. The sheet is originally travelling at a distance of 3 to 5 mm from wall 12. The registration edge 13 is approximately 10 to 12 mm outboard (toward the left in FIG. 1) of the wall 12 in its outboard mode, as shown, and about 2 mm inboard of the wall 12 in the inboard position. This outboard distance is shown as distance R. If this distance is too large the paper may develope a buckle between the paddle wheels 14, 15 and the registration edge 13.

As the paper proceeds on its path is comes in contact with paddle wheel 14 which drives the paper in the direction of arrow F1. The paddle wheel 14 drives the sheet in a clockwise direction, forcing the sheet to pivot about a pivot point which is coincident with the location of the paddle wheel 14. The corner of the sheet 11 will contact the edge 13 at point C1, and it is here that the corner of the sheet is likely to be come buckled or folded. As shown, the sheet 11 contacts the second ball 17 before the corner of the sheet contacts point C1, therefore slowing the paper just before the contact. As the paper slides further along the paper path, the second paddle wheel 15 will also drive the sheet. The combined action of the two paddle wheels results in an acceleration of the paper. The paddle wheels 14, 15 are 100 mm apart.

To minimize the damage to the corner of the paper sheet, two solid TEFLON balls 8, 9 are positioned at points 16 and 17. Point 16 is directly to the right of the paddle wheel 14 as shown in FIG. 1*a*, at a distance of 80 mm, and point 17 is directly below point 16 at a distance of 50 mm. The result is that the vector from the corner 53 of the wall 12 to the first paddle wheel 14 is about the same as one from the first paddle wheel 14 to the second ball 17. The TEFLON ball enclosures do not bias or constrain the balls in any way, except to keep them at their lateral positions, and it is only the weight of 8 to 9 grams each, friction, and inertia of these balls that reacts with the paper.

As the sheet travels downward in FIG. 1*a* it first comes in contact with paddlewheel 14 which drives the leading edge to the left, toward the registration edge 13. However, the actual force generated by the paddlewheel 14 on the paper is variable, depending on the type, size and weight of paper and the wear condition of the paddlewheel. This force, F1, may vary by as much as 180%. It is because of this variation that previous systems allowed a certain amount of corner damage and lack of full registration. To correct for this variation, the Teflon ball 9 provided at point 16 retards both the angular and linear velocity of the sheet, inducing a counter-moment or skew, so that it will not impact the edge 13 too heavily. As shown, as the sheet 11 continues, it must also react with the second ball 8 at point 17 just before the corner contacts the edge 13.

When the paper first contacts the ball, the ball is stationary, and the amount of friction produced between the stationary ball and the moving paper is at a maximum. As the paper continues to slide under the ball, the ball gradually picks up a rotational velocity, and the horizontal element of the force applied by the ball to the paper lessens. However, the vertical force of the ball on the paper, of course, remains constant.

In the outboard mode shown in FIG. 1*a*, the angle 20 between the paper 11 and the registration edge 13 can vary up to 16 degrees in this described embodiment. The lateral distance M between the paddle wheels 14, 15 and the balls 8, 9 determines the amount of resistance there will be to the angular velocity the paper will achieve, and is approximately 80 mm. For proper operation the distance R should also be approximately the same length. The distances K1, K2 will determine the amount of reduction there will be in linear paper velocity. In the described embodiment K1=72 mm, K2=142 mm. The first paddle wheel 14 is angled 25 degrees about an axis perpendicular to the plane of paper 11, as shown, and the second paddle wheel 15 is angled 40 degrees. The distance between balls 16 and 17 is 72 mm and the distance R between the registration edge 13 and the center line of the paddle wheels 14, 15 is 80 mm. The distances between the first wheel 14 and the second wheel 15, and also the distance between the second wheel 15 and the take-away rollers 43 must both be less than the width of the sheet, 8½ inches, so that the paper will always be under positive control.

The paddle wheels are driven at about 1625 to 1650 rpm, to a maximum rate of 1800 rpm, by motors 32, shown in dotted lines. These motors are mounted on a metal sheet 2.5 mm above and parallel to the paper sheet. The motor 32 is mounted on this metal sheet so that the motor 32 is higher than the paddlewheel 14, resulting in an angle of about 20 degrees between the motor axis and a horizontal plane. The assembly holds the paddle wheel just high enough above the paper so that the full width of the paddle wheel blade ends will contact the surface of the paper.

Figure 1B:
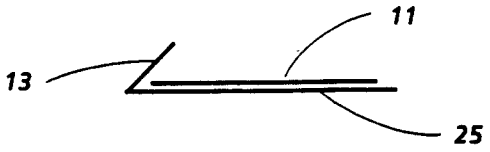
FIG. 1*b* is a side view of the registration edge.

FIG. 1*b* is an end view of the registration edge 13. It is angled so that when the sheet 11 approaches the edge, the sheet will be forced down into contact with the base plate 25. Otherwise the paper may float upward.

Figure 2A:
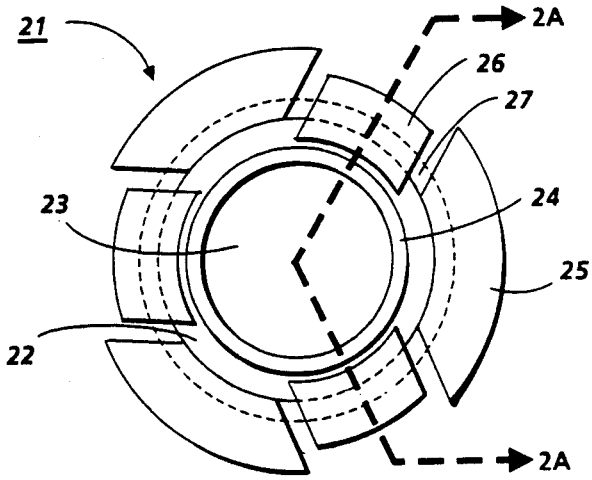
FIGS. 2*a*, 2*b* and 2*c* are three views of the ball retainer.

FIG. 2*a* is a top view of the ball retainer 21 which is mounted on this metal sheet. It is made from injection molded plastic and is flexible to a degree, but could be made from any other suitable material. The base 22 is a circular section having a hole 23 at its center. The upper inside edge of this bottom section has an angled portion 24 as shown. Connected to the base 22 by a cylinder 27 is a first set of brackets 25 which engage the bottom surface of the metal sheet, and a second set of brackets 26 which engage the top surface of the metal sheet, thus capturing the retainer in position on the metal sheet. The overall diameter of the retainer is 3.2 cm, and the diameter of the hole 23 is 2.1 cm to allow only a chordal section of the ball to protrude. The TEFLON ball is approximately 0.75 inches (19 mm) in diameter.

Figure 2B:
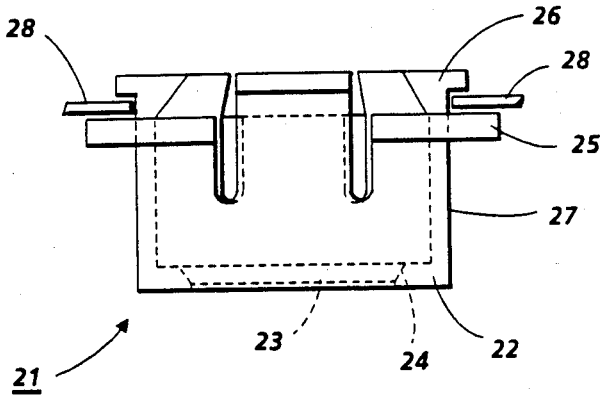

FIG. 2*b* is a side view of the retainer 21, showing the base 22, the angled corner 24, the inside edge 27 of the base which defines the hole, the cylinder 27, the first set of brackets 25, and the second set of brackets 26. The metal sheet from which this retainer is fabricated is approximately 1.9 mm thick, as is the gap between said first 25 and second 26 brackets. The height of the retainer 21 from the bottom of the base 22 to the bottom of the metal sheet 28 is 17 mm. Brackets 28 hold the retainer 21 in place.

Figure 2C:
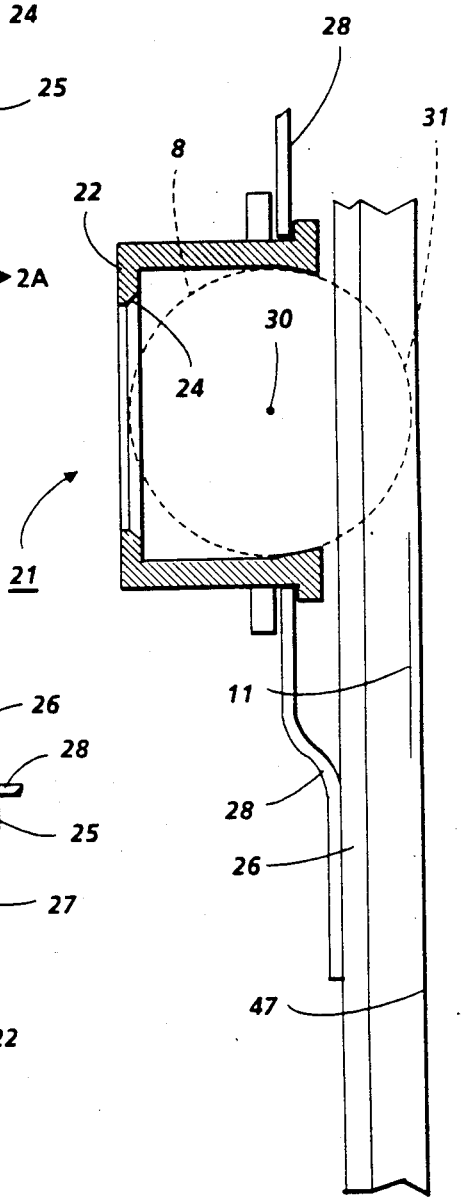

FIG. 2*c* is taken from section A—A of FIG. 2*a*. This view shows the inside edges of the second set of brackets 28 which connect the retainer 21 to the metal sheet 26. The ball 8, shown in dotted lines, is captured within the retainer with its center point at approximately point 30, resulting in the bottom surface of the ball protruding through metal sheet 26 as shown by dotted line 31. The sheet of metal 26 has previously been described as being parallel to, and 2.5 mm above, the plane of the paper 11, which itself is being supported by the registration mechanism's metal base plate 47.

Figure 3A:
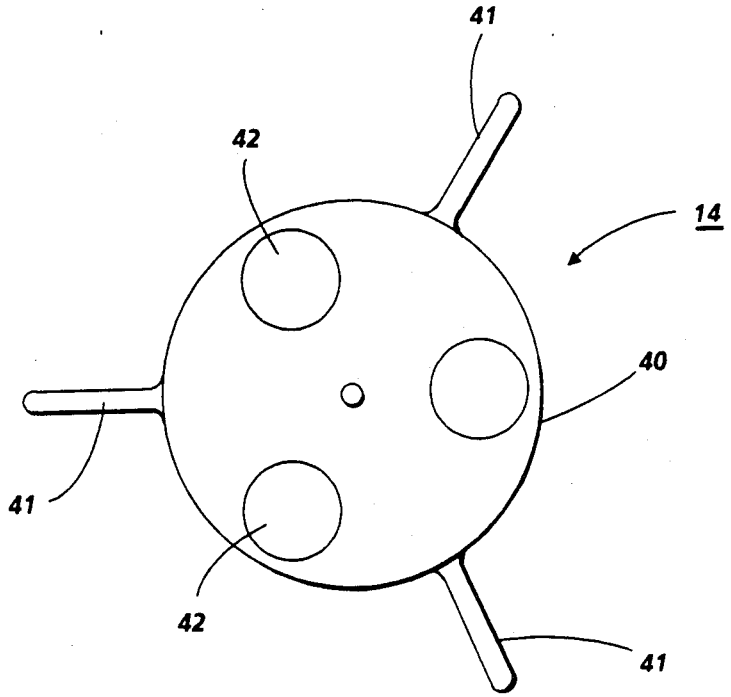
FIG. 3*a* is a side view of the paddle wheel.

The end view of the paddle wheel is shown in FIG. 3*a*, and comprises a central cylinder or hub 40 and a three vanes 41, molded in one piece from flexible polyester or polyether urathane by the centrifugal open cast method. The mold is coated prior to molding with a TEFLON surface treatment to aid in the release of the unit from the mold. If there is a concentration of release agent anywhere in the vane area, the resulting vane will have a corresponding cavity which may weaken the structural integrity of the vane. A vane thickness of about 1.9 mm and a vane width of about 15 mm were chosen for this described embodiment. The hub of the wheel 42 is cast with three holes 42 to provide additional flexibility to the hub, which lessens the amount of stress and wear on the vanes.

Figure 3B:
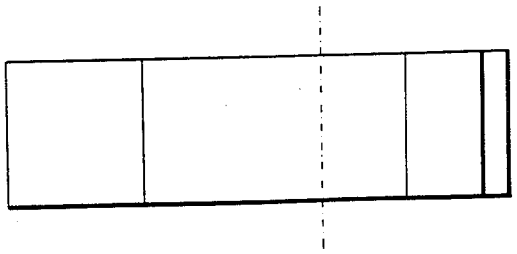
FIG. 3*b* is an end view of the paddle wheel.

FIG. 3*b* is a side view of the paddle wheel, showing a uniform width of the entire unit of 15 mm.

Figure 4:
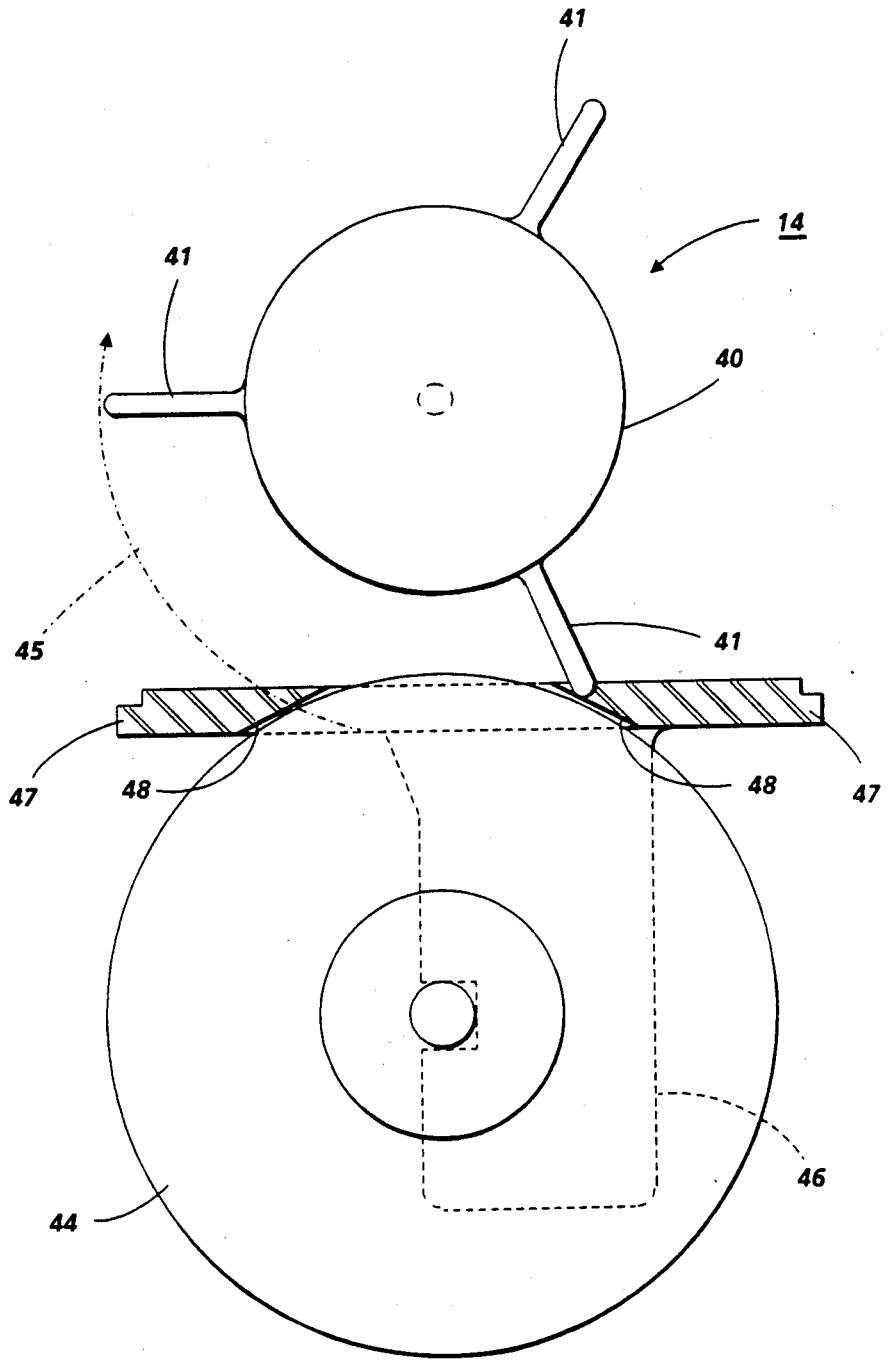
FIG. 4 is an end view of the wheel and roller.

FIG. 4 shows the relative positions of the paddle wheel 14 and roller 44. A hole is made in the base plate 47 to accomodate the roller 44. The roller 44 is 38 mm wide and protrudes above the upper surface of the plate 47 by 1 mm. The roller 44 is attached to the bottom of the plate 47 by two brackets 46. The arc of the wheel overlaps the circumference of the roller 44 by a considerable amount, as shown, so that in the absence of an intervening sheet of paper, the roller will quickly accelerate up to the speed of the wheel 14. In addition to reducing wear on the wheel, the provision of the roller 44 also results in an increased pull force on the sheet, compared to the pull force generated by the paddle wheel operating against a smooth base plate.

While the invention has been described with reference to a specific embodiment, it will be understood by those skilled in the art that various changes may be made and equivalents may be substituted for elements thereof without departing from the true spirit and scope of the invention. In addition, many modifications may be made without departing from the essential teachings of the invention.

I claim:

1. A mechanism for offsetting and registering a sheet of paper as it is traveling in a forward direction so that the outboard edge of said paper is brought into contact with a registration edge, comprising, first means for urging said sheet forward and in the outboard direction, the distance between said first means for urging and said registration edge being less than half the width of the leading edge of said sheet, said first means comprising a paddlewheel comprising a central hub and a plurality of vanes, said vanes being relatively short and numbering between two and four to allow a period of no contact between said paddlewheel and paper between succesive contacts between said paper and paddlewheel vanes, and second means for retarding the motion of said sheet comprising a retainer, and a ball which is retained within said retainer, and retainer comprising surfaces on all sides of said ball to restrain the translational movement of said ball while allowing said ball to move vertically and rotationally, said second means located between said first means for urging and the inboard edge of said sheet.

2. The mechanism of claim 1 further comprising a second means for urging said paper sheet forward and in the outboard direction located forward of said first means for urging, the distance between said second means for urging and said second registration edge being less than half the width of the leading edge of said sheet, the distance between said first and second means for urging being less than the forward dimension of said sheet.

3. The mechanism of claim 2 further comprising a second means for retarding located on the inboard side of said first means for urging, and forward of said first means for retarding.

4. The mechanism of claim 3 wherein said means for urging are mounted above the plane of said sheet so that the lower portion of the arc of said vanes is in contact with said sheet in the presence of a sheet, and further comprising two rollers, each mounted below the plane of said sheet and directly under a means for urging, the axis of rotation of said rollers being parallel to the axis of rotation of said means for urging, said rollers positioned so that the upper arc of said rollers are in contact with the lower arc of said means for urging in the absence of a sheet.

5. The mechanism of claim 3 wherein the outer surfaces of said balls are Teflon.

6. The mechanism of claim 3 wherein the axis of rotation of said first and second means for urging is angled upward in the inboard direction.

7. The mechanism of claim 6 wherein the angle between the plane of rotation of said first and second means for urging and said registration edge is between twenty and thirty degrees, and thirty and forty degrees, respectively, wherein the angle between the axis of rotation of said means for urging and the plane of said sheet is between zero and twenty degrees, and wherein the distance between said means for urging and said registration edge is between forty and one hundred millimeters.

* * * * *